US007196620B2

(12) United States Patent
Nanba

(10) Patent No.: US 7,196,620 B2
(45) Date of Patent: Mar. 27, 2007

(54) SENSOR MONITORING APPARATUS, MONITORING SYSTEM, SENSOR MONITORING METHOD AND PROGRAM

(75) Inventor: Katsushi Nanba, Nagoya (JP)

(73) Assignee: Fujitsu Limited, Kawasaki (JP)

( * ) Notice: Subject to any disclaimer, the term of this patent is extended or adjusted under 35 U.S.C. 154(b) by 70 days.

(21) Appl. No.: 10/992,904

(22) Filed: Nov. 22, 2004

(65) Prior Publication Data

US 2005/0156728 A1 Jul. 21, 2005

Related U.S. Application Data

(63) Continuation of application No. PCT/JP02/07002, filed on Jul. 10, 2002.

(51) Int. Cl.
*G08B 29/00* (2006.01)
*G08B 5/22* (2006.01)

(52) U.S. Cl. ..... 340/506; 340/825.37

(58) Field of Classification Search ..... 340/539.14, 340/539.16, 539.17, 539.22, 539.26, 7.22, 340/506–514, 815.45; 709/223
See application file for complete search history.

(56) References Cited

U.S. PATENT DOCUMENTS 6,564,056 B1 * 5/2003 Fitzgerald ..... 455/435.1
6,580,950 B1 * 6/2003 Johnson et al. ..... 700/17
6,693,530 B1 * 2/2004 Dowens et al. ..... 340/506
6,850,149 B2 * 2/2005 Park ..... 340/7.1
7,039,698 B2 * 5/2006 Slemmer et al. ..... 709/223
2003/0071724 A1 * 4/2003 D'Amico ..... 340/506

FOREIGN PATENT DOCUMENTS

| | | |
|---|---|---|
| JP | 05-250591 | 9/1993 |
| JP | 05-347672 | 12/1993 |
| JP | 08-106407 | 4/1996 |
| JP | 09-016880 | 1/1997 |
| JP | 2001-297384 | 10/2001 |
| JP | 2001-338372 | 12/2001 |

* cited by examiner

*Primary Examiner*—Daniel Wu
*Assistant Examiner*—Jennifer Mehmood
(74) *Attorney, Agent, or Firm*—Staas & Halsey LLP

(57) ABSTRACT

A sensor monitor comprises a sensor monitoring section for monitoring a sensor, notifying section for notifying a first notifying destination of a predetermined state when sensed by the sensor, notification confirming section for confirming that the notification has been recognized by the first notifying destination, and control section for deciding a second notifying destination in case of the incapability of confirming that the notification has been recognized, and notifying the notifying means of it.

13 Claims, 8 Drawing Sheets

SENSOR MONITORING APPARATUS, MONITORING SYSTEM, SENSOR MONITORING METHOD AND PROGRAM

This is a continuation of Application PCT/JP2002/07002, filed on Jul. 10, 2002.

BACKGROUND OF THE INVENTION

1. Technical Field

The present invention relates to an information apparatus for notifying of information given from sensors.

2. Background Arts

A field of welfare has hitherto been provided with a notification system for notifying, e.g., a disabled person in his or her auditory sense of an arrival of a visitor through an optical lamp when the visitor presses an interphone. Further, there has been provided a system for detecting boiling of a cooking utensil, baby crying in a house, etc., and notifying of it through a monitor or a notifying lamp.

In the conventional systems, however, the following problems arise. For example, an individual using a personal computer in concentration for a long period of time is hard to monitor the monitor and the notifying lamp at all times, and therefore has a high possibility of overlooking the notification.

Further, in the conventional system, a dedicated cable is often formed integrally with the sensor, and the cable has a limit of its length, wherein a notification range is confined. For instance, a general type of visitor notification system for the disabled persons in their auditory sense is that the interphone at an entrance hall is connected by a cable directly to a light emitting lamp in a room. Therefore, a majority of this type of systems can not be installed unless within a space between the entrance hall and rooms close to the entrance hall.

Furthermore, there are many systems requiring special pieces of hardware that are not easily available. For instance, the notification system for welfare provided in a self-governing body, etc. is generally difficult for acquisition, and the number of systems provided for each person is limited.

Moreover, the majority of conventional systems are constructed by fixing dedicated sensors and dedicated notifying apparatus, and do not come under a category of universal-free. For example, the notification through a sound is not suited to the disabled persons in their auditory sense. Further, a visual notification through light is not suited to the disabled persons in their visual sense.

Still further, generally, the notification system utilizing the sensors is easy to be specialized for the purpose of security, and is small of a degree of freedom and extensibility of arrangement.

SUMMARY OF THE INVENTION

The present invention was devised in view of the problems inherent in the prior arts described above. Namely, it is an object of the present invention to provide a technology capable of surely notifying a user of information from generalized sensors by flexibly connecting these sensors to a notifying destination without using special systems and apparatus specialized for the purpose of security.

To accomplish the above object, the present invention adopts the following means. To be specific, the present invention is a monitoring apparatus comprising a sensor monitoring unit monitoring a sensor, a notifying unit notifying, when the sensor detects a predetermined state, a first notifying destination of this purport, a notification confirming unit confirming that the notification has been recognized at the first notifying destination, and a control unit determining, if unable to confirm that the notification has been recognized, a second notifying destination and making the notifying means give the notification to the second notifying destination.

The sensor monitoring unit is connected to the sensor via, e.g., an input terminal and obtains output data of the sensor. The notifying unit notifies the first notifying destination that the sensor has detected the predetermined state. Further, the notification confirming unit checks whether or not the notification has been recognized at the first notifying destination. Then, if unable to recognize, the control unit determines the second notifying destination, and causes the notifying unit to notify the second notifying destination.

Preferably, the monitoring apparatus may further comprise a notifying destination recording unit recording a plurality of notifying destinations, and an operation detecting unit detecting an operation state of the notifying destination, wherein the control unit may determine the second notifying destination on the basis of the operation states of the plurality of notifying destinations.

Thus, the second notifying destination is determined based on the operation states from within the plurality of notifying destinations, and it is therefore possible to select the notifying destination exhibiting a high possibility that the notification is to be recognized.

Further, the present invention may also be a processing apparatus connected to a monitoring apparatus comprising a sensor monitoring unit monitoring a sensor, a notifying unit notifying, when the sensor detects a predetermined state, a first notifying destination of this purport, a notification confirming unit confirming that the notification has been recognized at the notifying destination, and a control unit determining, if unable to confirm that the notification as been recognized, a second notifying destination and making the notifying means give the notification to the second notifying destination, the processing apparatus being connected to the sensor, and receiving the notification from the monitoring apparatus, the processing apparatus comprising a communication unit communicating with the monitoring apparatus, an operation judging unit judging an operation state of the monitoring apparatus, and a substitute unit functioning, if the monitoring apparatus is not under operation, as the sensor monitoring unit, the notifying unit and the control unit.

Thus, the processing apparatus, which is originally constructed to receive the notification from the aforementioned monitoring apparatus, is made to become the substitute for the functions of the monitoring apparatus, whereby the processing apparatus can monitor the sensor if the monitoring apparatus falls into a fault or disorder, and reliability on the system can be enhanced.

Moreover, the present invention may also be a system configured by combining the sensor with the monitoring apparatus. Still further, the present invention may also be a system configured by combining the above system with aforementioned processing apparatus.

Yet further, the present invention may be a method by which a computer, other apparatus, machine, etc. executes any of the processes described above. Moreover, the present invention may also be a program making the computer, other apparatus, machine, etc. actualize any one of the functions or steps or processes described above. Furthermore, the present invention may also be a storage medium stored with such a program that is readable by the computer, other apparatus, machine and so forth.

DETAILED DESCRIPTION OF THE PREFERRED EMBODIMENT

A preferred embodiment of the present invention will hereinafter be described with reference to the drawings.

<System Architecture of Information System>

Figure 1:
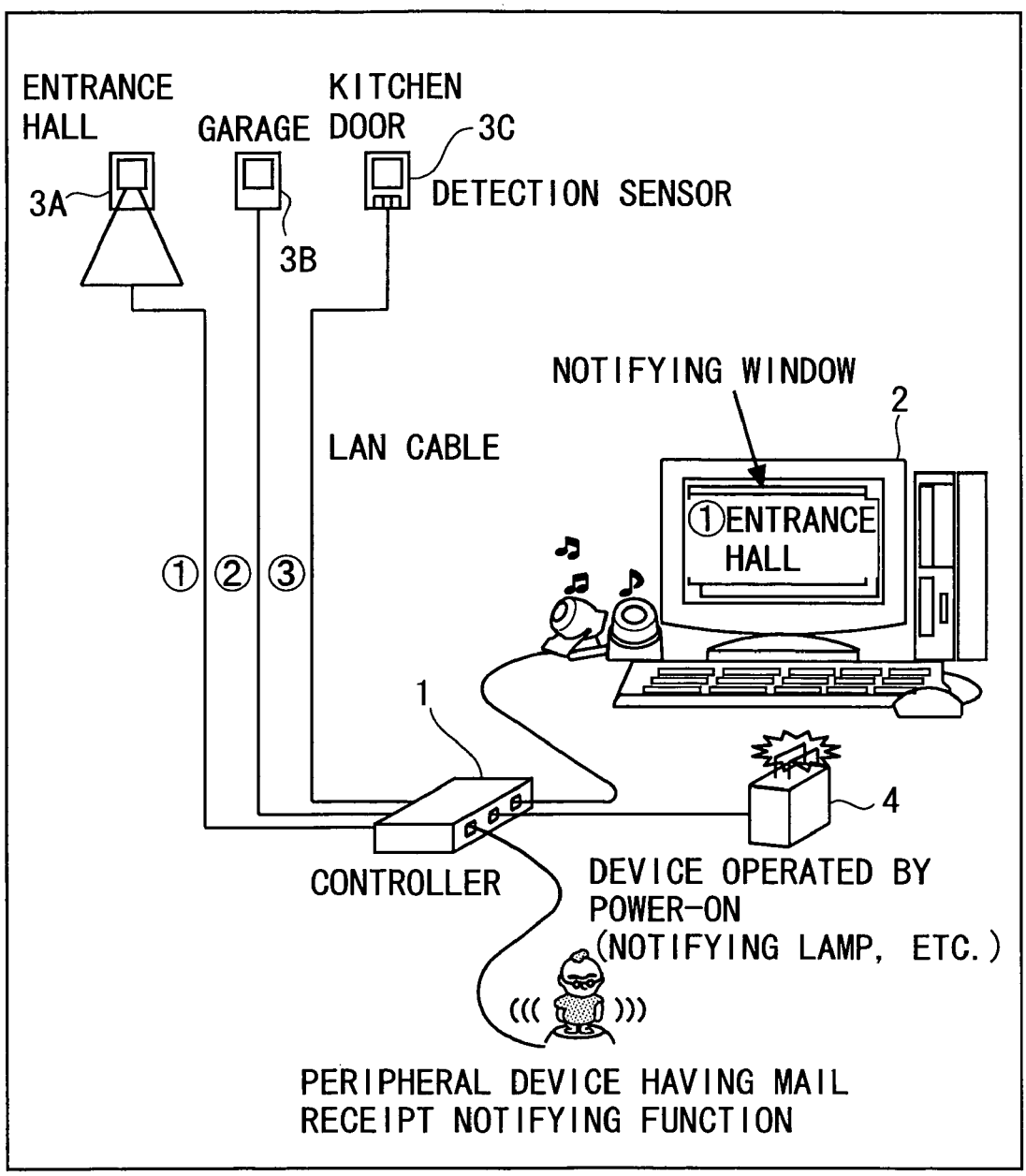
FIG. 1 shows a view of a system architecture of an information system in a first embodiment of the present invention.

FIG. 1 shows a view of a system architecture of an information system in a first embodiment of the present invention. This information system includes sensors 3A through 3C, etc. installed at an entrance hall of a building (house), a garage, a kitchen door and the like, a controller 1 connected via a communication cable to these sensors, an output device 4 connected to the controller 1 and receiving a predetermined notification from the controller 1 on the basis of states of the sensors 3A, etc., and a personal computer 2. In the present embodiment, the personal computer 2 also receives the notification from the controller 1 in the same way as the output device 4 does.

The sensors 3A, etc., which are installed at the entrance hall, the garage, the kitchen door and so on, detect whether a visitor is there or not, a door opening/closing state, whether a car exists, enters and exits or not, etc., and notifies the controller 1 of a detected state. The sensors 3A, etc. are, for example, an infrared-ray sensor for detecting an existence of a person, a contact switch for detecting whether the door is opened or closed, an area sensor for detecting an existence of the car, and so forth. The sensors 3A, etc. input the detected states to input terminals of the controller 1 via the communication cable by use of an ON or OFF signal.

The controller 1 always monitors the signals coming from the sensors 3A at its input terminals each identified by a terminal number. Then, when a state variation occurs in each sensor, for example, when detecting the visitor, etc., the controller 1 notifies the personal computer 2 or a predetermined output device 4, etc. of the terminal number of the input terminal and of a purport that the state variation has been detected by the sensor corresponding to this input terminal.

Namely, the controller 1 is a device for gathering pieces of information from the sensors 3A, etc., determining which device should be notified of, and giving the notification in a way that switches over a destination of the notification each time. For actualizing these functions, the controller 1 has a built-in CPU and is pre-installed with a control program to be executed by the CPU. The controller 1 further has a built-in function of sending a mail to the destination of the notification. Hence, the destination of the notification by the controller 1 may also be a cellular phone.

Moreover, the controller 1 also includes a function of permitting a flow of electric current and therefore, if a device is operated by the electric current in the same way as a notification-oriented lamp is, enables this device to be utilized as the output device 4 shown in FIG. 1. Furthermore, the controller 1 is capable of detecting a device which is under operating, from a plurality of output devices 4 and also capable of being controlled by the personal computer 2.

The output device 4 has functions of transferring the notification from the controller 1 to a user through, for instance, user's own five senses such as a visual sense, an auditory sense, a tactile sense and so on. The output device 4 may be exemplified such as the notification-oriented lamp that emits predetermined light, a buzzer that emits a predetermined sound, a vibrator that transfers a receipt of the notification from the controller 1 to the user, a voice output device that reads the notification in voice, a display device that outputs characters or an image, and so forth.

Furthermore, the output device 4 may also be a mail receipt notifying device such as a mascot robot having a mail receiving function, and so on. In the case of such a construction, when abnormality occurs, the mascot robot performs a predetermined action, which is effective in notifying through the visual sense.

The personal computer 2, upon the notification from the controller 1, displays the state transitions detected by the sensors 3A, etc. on the display device in character, image, voice and so forth. A configuration and an operation of the personal computer 2 are widely known, and hence the explanations thereof are omitted.

The sensors 3A, etc. perform communications with the controller 1 via the communication cable (e.g., a LAN cable or a telephone cable, etc.). The sensors to which such a generalized cable is connectable are employed, whereby the cable can be laid to an arbitrary length and can be extended, and physical restrictions of an installation range of connected devices, etc. are obviated.

The controller 1 in the present embodiment has the plurality of input terminals to which the plurality of sensors are connected. Further, the controller 1 in the present embodiment has the plurality of output terminals to which the plurality of personal computers 2 or the plurality of output devices 4 can be connected.

<Outline of Processing Procedure>

Figure 2:
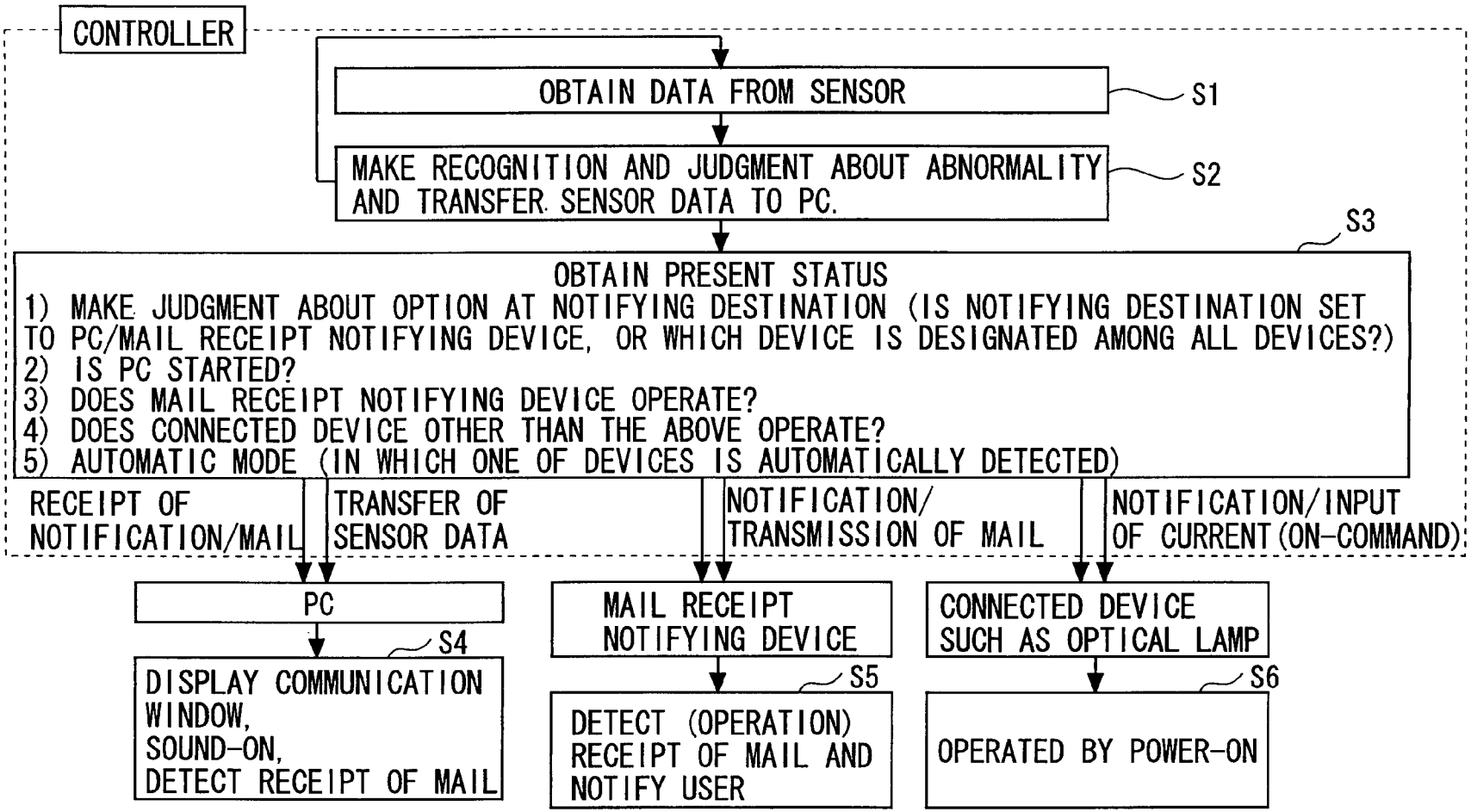
FIG. 2 a diagram of an outline of a notifying destination switchover procedure by a controller 1 for notifying of information from sensors.

FIG. 2 shows an outline of a notifying destination switchover procedure by the controller 1. The controller 1, at first, obtains data from the sensors 3A, etc. via the respective input terminals (S1).

Then, the controller 1 recognizes a type of the corresponding sensor, a place at which setting up thereof, etc. from the terminal number of the input terminal. Moreover, the controller 1 judges based on a signal from this sensor whether the abnormality occurs or not. Then, the controller 1 adds the terminal number of the input terminal to the data (sensor data) from each sensor, and thus transfers the sensor data to the personal computer 2 (S2). This transfer enables the personal computer 2 to process the sensor data.

Next, the controller 1 judges an option of the notifying destination, and judges a present state of the notifying destination designated by this option (S3). The following is a detailed description of the judging process.

1) The controller 1 judges the option of the notifying destination. To be specific, the controller 1 judges which notifying destination is designated from among the personal computer 2, the mail receipt notifying device and other notifying destinations.
2) The controller 1 judges whether the personal computer 2 is started or not.
3) Further, the controller 1 judges whether the mail receipt notifying device operates or not.
4) The controller 1 judges whether the output device 4 (the connected device) other than those described above operates or not.
5) Then, in an automatic mode, the started device is automatically detected from among those devices. The automatic mode connotes a processing mode of the controller 1, in which the notifying destination is determined by a process of the program built in the controller 1.

For example, whether the notifying destination such as the personal computer 2 or the mail receipt notifying device, etc. has been started or not can be judged by executing a ping command defined as an application program of TCP/IP. Further, the controller 1 and the personal computer 2 may check a started status for each other from a predetermined output signal (indicating, e.g., a ready status, a standby status and so on).

Subsequently, the controller 1 sends to the personal computer 2 a notification or an e-mail purporting that the abnormality has occurred. As a result, the sensor data are processed not by the personal computer 2 but by the controller 1, and a result of this processing can be displayed on the personal computer 2.

In this respect, the personal computer 2, when detecting the receipt of the notification, the e-mail or the sensor data, displays a notification window and emits a sound or a voice (S4).

Further, the controller 1 sends to the mail receipt notifying device the notification or the e-mail purporting that the abnormality has occurred. In this point, the mail receipt notifying device, when detecting the e-mail for the user, notifies the user of this purport through the sound, the light, the action, etc. (S5).

Moreover, the controller 1 sends the notification purporting that the abnormality has occurred to the optical lamp or other connected device, or alternatively outputs a predetermined drive current thereto. In response to this, other connected device is operated by the inputted current (S6).

Figure 3:
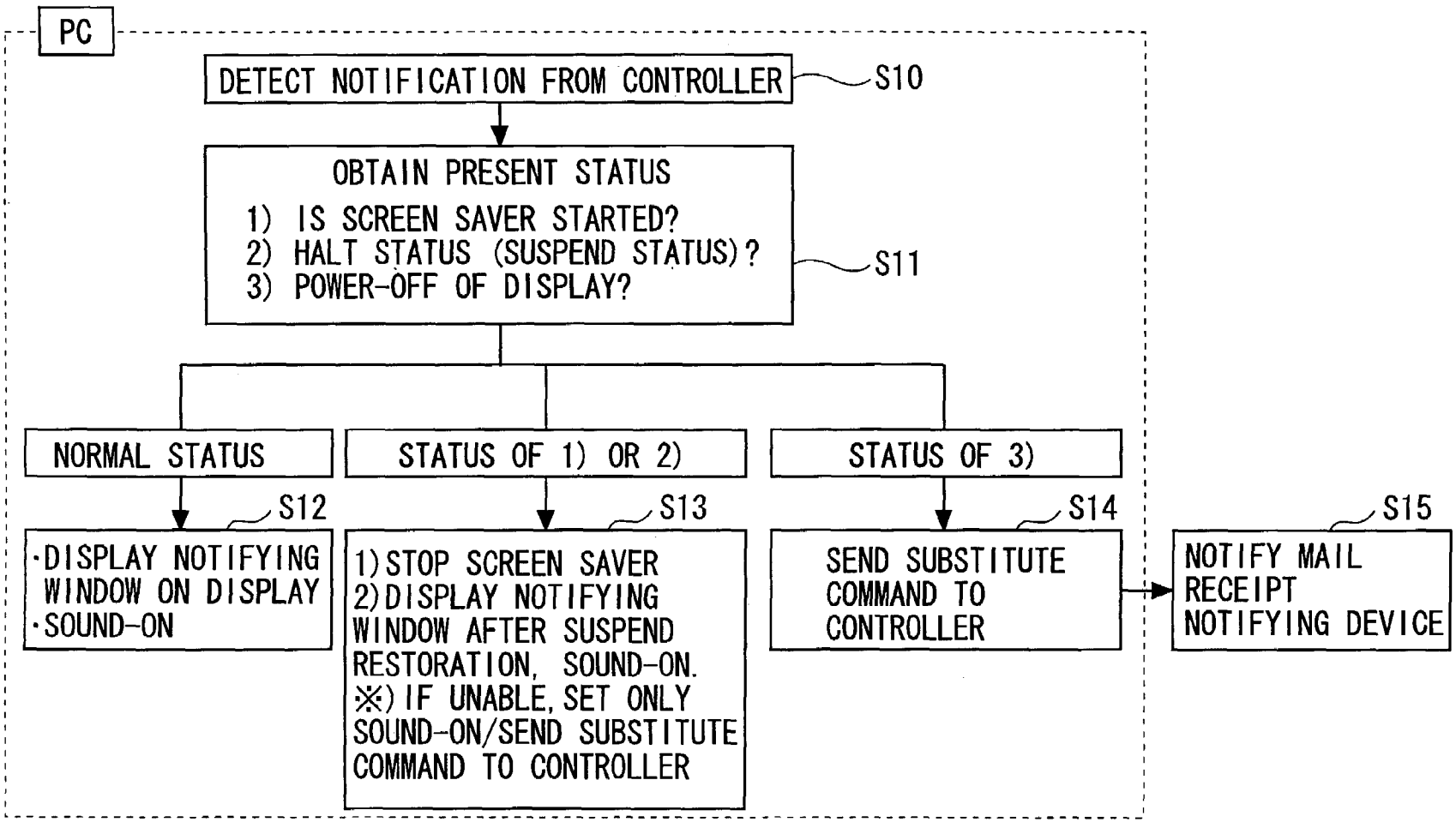
FIG. 3 is a diagram of an outline of an output function of a personal computer 2 for outputting the information based on a notification given from the controller 1.

FIG. 3 is a diagram showing an outline of the output function of the personal computer 2. The personal computer 2 in the present embodiment detects the notification given from the controller 1 and outputs various pieces of information to the user.

The personal computer 2, to begin with, detects the notification given from the controller 1 (S10). Then, the personal computer 2 acquires a present self-status (S11). The status herein connotes, e.g., 1) a started status of a screen saver, 2) a halt status (a suspend status), 3) a power-off status of the display, and so forth. Then, the personal computer 2 outputs pieces of information corresponding to these statuses.

For instance, when the personal computer 2 is in none of those statuses (this is called a normal status), the personal computer 2 displays the notification window on the display device (display). Further, the personal computer 2 emits a sound (sound) corresponding to this notification window (S12).

Moreover, for example, when the screen saver is in the started status, the personal computer 2 stops the screen saver. Further, the personal computer 2, when in the suspend status, restores from the suspend status. Then, the personal computer 2 displays the notification window, and gets the sound emitted, which corresponds to the notification window (S13).

Note that confirmation, though not shown in FIG. 3, may also be received from the user when outputting in S12 and S13. For example, the user may be prompted to click a confirmation button displayed on the display device by use of an unillustrated pointing device. The personal computer 2 may notify the controller 1 of whether the confirmation is made or not. The controller 1, if unable to obtain the confirmation from the user via the personal computer 2, may send the notification to other output device, e.g., the mail receipt notifying device.

Moreover, for instance, in case a power supply of the display is switched off, the personal computer 2 sends a substitute command to the controller 1. The substitute command connotes a notification given to the controller, purporting that the personal computer can not effect the predetermined output. The controller 1, when receiving the substitute command from the personal computer 2, sends the notification to other output device, e.g., the mail receipt notifying device (S15).

It is to be noted that the personal computer 2 may, in S13 in FIG. 3, even if unable to restore from the suspend status, transfer the substitute command to the controller 1.

<Architecture of Hardware>

Figure 4:
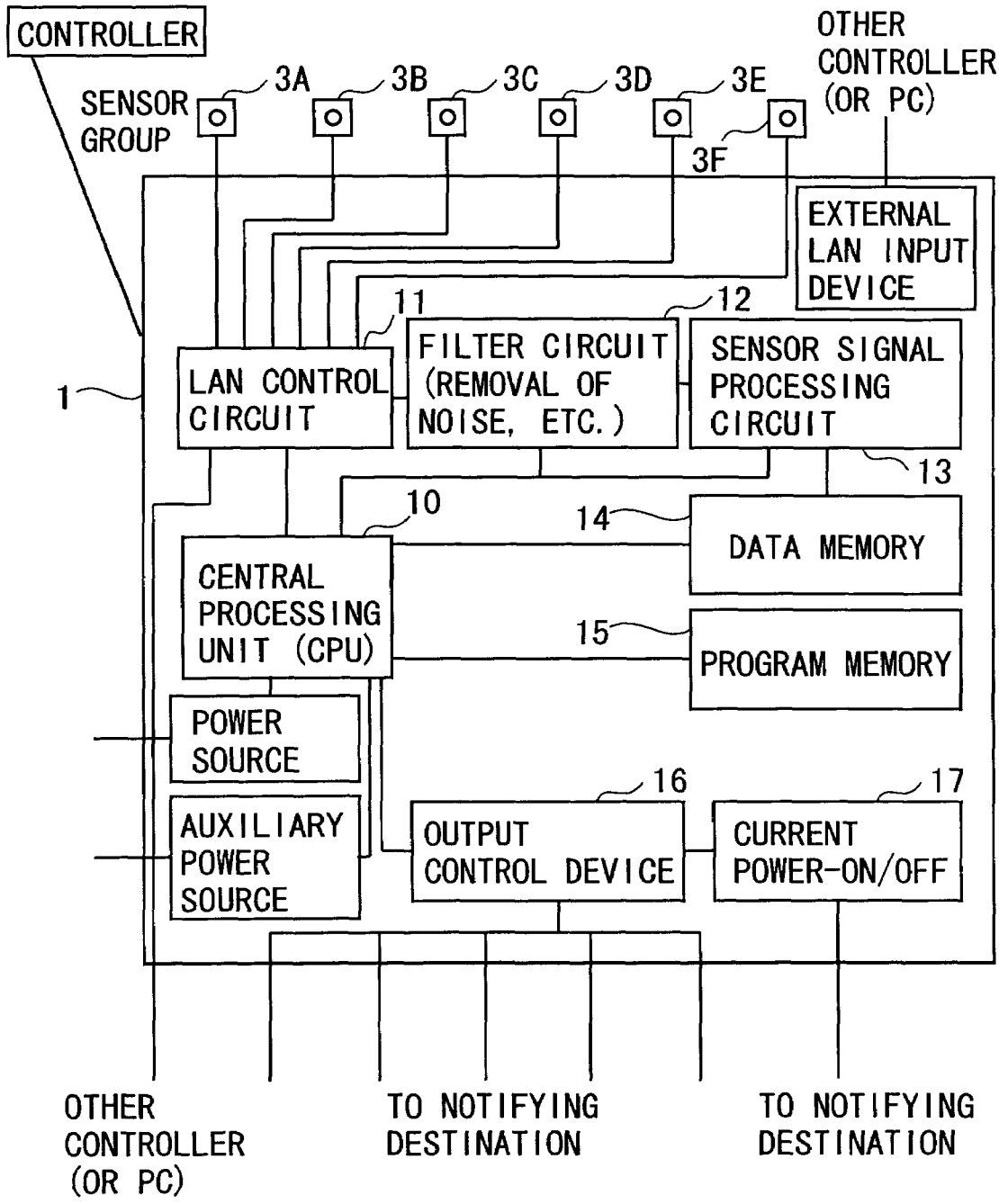
FIG. 4 is a block diagram of hardware of the controller 1.

FIG. 4 is a block diagram of hardware of the controller 1. As in FIG. 4, the controller 1 includes a LAN control circuit 11, a filter circuit 12, a sensor signal processing circuit 13, a data memory 14, a program memory 15, an output control device 16, a DC power ON/OFF circuit 17 and a CPU 10.

The LAN control circuit 11 reads the sensor data from a sensor group of the sensors 3A through 3F via the communication cable, and outputs the sensor data to output ports connected to the filter circuit 12, the CPU 10 or other controller (including the personal computer 2, etc.). Namely, the LAN control circuit 11 provided a function as a switch for outputting the signals of the predetermined input ports to the predetermined output ports.

The filter circuit 12 effects filtering of the sensor data inputted from the LAN control circuit 11, thereby executing removal of noises, etc.

The sensor signal processing circuit 13 performs sampling of the sensor data with a predetermined sampling period, and thus generates digital data. The generated digital data are stored together with the terminal number of the input terminal on the data memory 14 under the control of the CPU 10.

The program memory 15 is stored with a program executed by the CPU 10. The CPU 10 executes this program, thereby providing a function as the controller 1.

For example, the CPU 10, as described above, stores the sensor data given from the sensors 3A through 3F on the data memory 14. Further, the CPU 10, based on the sensor data, drives the output control device 16 or the DC power ON/OFF circuit 17, and transmits the notification, the e-mail or the drive current to the notifying destination.

The output control device 16 is, for example, a LAN board, etc., and sends the predetermined notification or the e-mail, etc. in response to a command given from the CPU 10. The DC power ON/OFF circuit 17 inputs the direct current to the notifying destination in response to a command given from the CPU 10. Thus, the CPU 10 notifies the user of a variation of the sensor data through the optical lamp, the buzzer and so forth.

Further, the controller 1 is connected to other controller or PC, etc. via the LAN control circuit 11 or an external LAN input device.

Moreover, in the case of desiring to connect a greater number of sensors than the number of the input terminals provided in the single controller, these extra sensors are connected to a second controller. Further, the first controller is connected to the second controller via the LAN control circuit 11 or the external LAN input device. At this time, the CPU 10 of the first controller 1 gives initial values of usable terminal numbers to a CPU of the second controller through the communications between the controllers. The CPU of the second controller may assign the terminal numbers to the input terminals to which pieces of sensor data from the respective sensors are inputted, wherein the given terminal numbers are set as the initial values.

<Operation>

Figure 5:
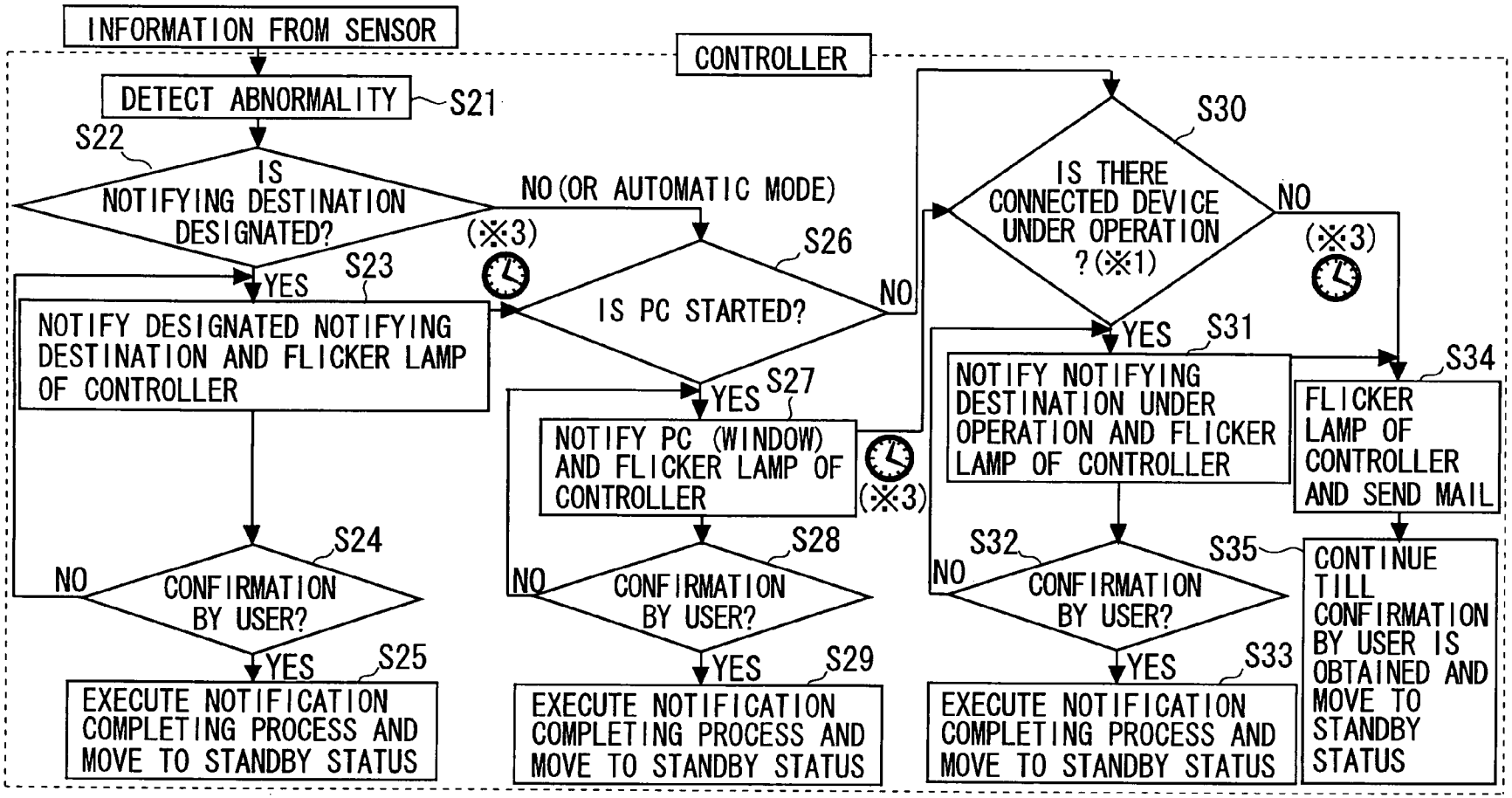
FIG. 5 is a flowchart showing the notifying destination switchover process by the controller 1.

FIG. 5 is a flowchart showing the notifying destination switchover process by the controller 1. The CPU 10 within the controller 1 executes the computer program stored on the program memory 15, thereby actualizing this notifying destination switchover process.

In this process, to start with, the CPU 10 detects abnormality from information given from the sensor (S21). Herein, the detection of the abnormality implies that the sensor detects a change from a closed state of the door of the entrance hall or the kitchen door, etc. to an unclosed state, the sensor at the entrance hall or the kitchen door, etc. detects a figure (person), and so forth.

Upon the detection of the abnormality, the CPU 10 judges whether the notifying destination about this abnormality is designated or not (S22). When the notifying destination is designated, the CPU 10 notifies the designated notifying destination. Further, the CPU 10 flickers the lamp provided on the controller 1 (S23).

Then, the CPU 10 judges whether or not the user confirms the notification at the notifying destination (S24). The confirmation of the notification connotes such a case that the user presses the predetermined confirmation button at the notifying destination. When the confirmation described above is made by the user, the notifying destination sends a response of gaining the confirmation back to the controller 1. The notifying destination may send this response by, e.g., the e-mail.

When the response about the confirmation by the user is sent from the notifying destination, the CPU 10 executes a notification completing process and returns to the standby status (S25). While on the other hand, when the response about the confirmation by the user is not obtained, the CPU 10 returns the control to S23. The processes in S23 and S24 are repeated till the confirmation by the user is obtained.

Then, if there is none of the confirmation by the user even after a predetermined period of time has elapsed, i.e., if the user is not aware of the notification, the CPU 10 moves to the automatic mode. Further, when judging the notifying destination not to be set in S22, the CPU 10 likewise moves to the automatic mode.

According to the present embodiment, in the automatic mode, the CPU 10 gives the notification preferentially to the personal computer 2. This is because, if the user engages in working for a long period of time by use of information device such as the personal computer 2, etc., or if the user concentrates the attention on such a type of working, the user might often overlook the notification given other than on the display device of the information device under working. Moreover, there is a case of being capable of effectively notifying the disabled persons in their auditory sense by displaying the notification on the display device of the personal computer 2, etc.

Then, the CPU 10 judges whether or not the personal computer is started or not (S26). Subsequently, when the personal computer 2 is started, the CPU 10 sends the notification to the personal computer 2. Further, the CPU 10 flickers the lamp provided on the controller 1 (S27). At this time, the notification window is displayed on the personal computer 2.

Then, the CPU 10 judges whether or not the user confirms the notification on the personal computer 2 (S28). The confirmation of the notification implies that the user presses the predetermined confirmation button, e.g., an object on the display device of the personal computer 2 by using the pointing device, and so forth. When such a type of confirmation by the user is given, the personal computer 2 sends the response of gaining the confirmation back to the controller 1.

When the response about the confirmation by the user is sent from the personal computer 2, the CPU 10 executes the notification completing process and returns to the standby status (S29). While on the other hand, when the response about the confirmation by the user is not obtained, the CPU 10 returns the control to S27. The processes in S27 and S28 are repeated till the confirmation by the user is obtained.

Then, if there is none of the confirmation by the user even after the predetermined period of time has elapsed, i.e., if the user is not aware of the notification, the CPU 10 moves to a judging process in S30. Further, when judging the personal computer 2 not to be started in S26, the CPU 10 likewise moves to the judging process in S30. In the judging process in S30, the CPU judges whether or not there is any connected device under operation (S30).

When judging in S30 that there is the connected device under operation, the CPU 10 sends the notification to this connected device. Further, the CPU 10 flickers the lamp provided on the controller 1 (S31). Then, the CPU 10 judges whether or not the user confirms the notification at the notifying destination (S32).

For instance, if the connected device supports the mail receiving function, at first, a mail is delivered to this connected device. The connected device having received the mail starts operating. At this time, the controller 1 checks whether the mail is downloaded into a mail server of the user, thereby making it possible to detect whether the user confirms the connected device, i.e., the mail or not. Further, a mail unsealing confirmed notification may also be transmitted from the connected device.

Further, if the connected device is a device actuated by a Dc power source, the notification is given simply by causing a flow of the electric current, however, as for this point, the confirmation is made by detecting whether this connected device is active or not. Namely, if the electric current once flows, the connected device invariably must become active. Therefore, if the connected device remains active (operating) even after a predetermined period of time has elapsed, it may be judged that the user does not yet confirm.

When the response about the confirmation by the user is sent from the notifying destination, the CPU 10 executes the notification completing process and returns to the standby status (S33). While on the other hand, when the response about the confirmation by the user is not obtained, the CPU 10 returns the control to S31. The processes in S31 and S32 are repeated till the confirmation by the user is obtained.

Then, if there is no confirmation by the user even after the predetermined period of time has elapsed, i.e., if the user is not aware of the notification, the CPU 10 moves to a process in S34. Further, when judging the connected device of the notifying destination not to be started in S30, the CPU 10 likewise moves to the process in S34.

If unable to obtain the confirmation from the notifying destination in all the connected devices as in the case of an absence of the user; etc., and if the user carries a cellular phone, a mail is transmitted as a final means (S34). Whereas if not, there is taken a measure of continuing to flicker the lamp of the controller till the user gets aware of it.

In the case of obtaining the user's confirmation by executing the notifying process, the CPU 10 returns to the standby status defined as a normal status in preparation for a next process (S35). As described above, the CPU checks the mail server, etc. or receives the mail unsealing confirmed notification and so on, thereby making it possible to detect whether the user has confirmed the mail or not.

As described above, according to the present information system, when the abnormality or the state variation is detected from the sensor data, the notifying destination can be flexibly switched over. For instance, the notification of the abnormality or the state variation can be given in a way that selects the started device or the personal computer 2 under operation, etc. from the preset notifying destinations.

Moreover, according to the present information system, the security system based on an individual level can be configured by combining the LAN cable, the telephone line and the generalized sensors.

Further, according to the present information system, not only the persons in normal health but also the disabled persons in their visual sense, auditory sense, etc. can be notified of the abnormality or the state variation by combining the output devices of the notifying destination.

Still further, according to the present information system, even when exceeding the number (the number of input terminals) receivable by one single controller with the increased number of sensors, the system can be easily extended by increasing the number of controllers. Yet further, according to the present information system in the present embodiment, the sensor or the notifying device (the output device 4 in FIG. 1) can be installed in the place desired by the user without any restriction of a length of the cable, and it is feasible to reduce the possibility of overlooking the occurrence of the abnormality and the state variation.

<Modified Example>

In the embodiment discussed above, the sensors 3A, etc. are connected to the controller 1 via the communication cable such as the LAN cable and so on. As a substitute for this construction, however, the sensors 3A, etc. may also be connected to the controller 1 via wireless communications using a wireless LAN, Bluetooth, etc.

The embodiment discussed above has exemplified the system for notifying of the abnormality or the state variation in the sensor data in a way that connects the plurality of sensors to the single controller 1. The embodiment of the present invention is not, however, limited to this configuration. An available system is, for example, that one sensor is connected to one controller 1.

<<Second Embodiment>>

A second embodiment of the present invention will hereinafter be explained with reference to the drawings in FIGS. 6 and 7. The first embodiment has exemplified the information system including the controller 1 for detecting the abnormality or the state variation in the sensor data and notifying the predetermined notifying destination of it.

Explained in the second embodiment is an information system in which the personal computer 1, if the controller 1 falls into a fault in the above information system (the first embodiment), becomes a substitute for the function of the controller 1. Other elements and the operations are similar to those in the first embodiment. Such being the case, the same components are marked with the same numerals and symbols, and their explanations are omitted. Further, the drawings in FIGS. 1 through 5 are referred to according to the necessity.

<System Architecture>

Figure 6:
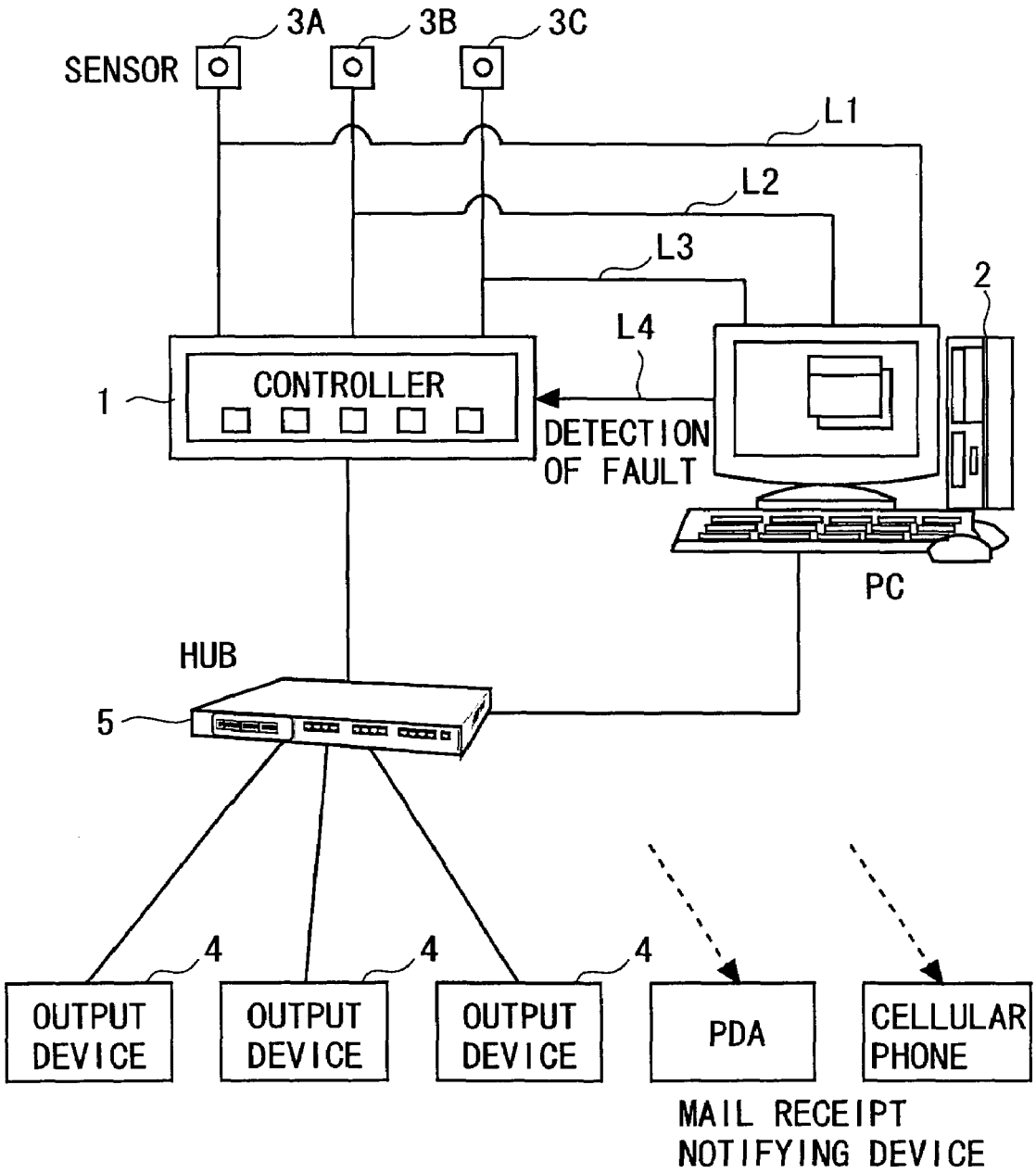
FIG. 6 is a view of a system architecture of the information system in a second embodiment of the present invention.

FIG. 6 shows a view of a system architecture of the information system in the second embodiment of the present invention. This information system also includes, as in the case of the first embodiment, the sensors 3A through 3C, etc., the controller 1, the personal computer 2, the output device 4, the mail receipt notifying device and so on.

In the second embodiment, however, the personal computer 2 has the same input terminals as those of the controller 1. Then, the sensor data are inputted (via communication cables L1, L2 and L3) to the input terminals of the personal computer 2 in parallel with the controller 1.

Further, the personal computer 2 includes a communication port (a communication cable L4) for communicating with the controller 1. The personal computer 2 monitors a status of the controller 1 via the communication cable L4 at a predetermined timing, e.g., immediately after the personal computer 2 has been started, or at a predetermined interval. Then, the personal computer 2, when detecting a fault or disorder of the controller 1, executes the substitute function of the controller 1.

Herein, the fault or the disorder of the controller 1 implies, for instance, a case in which the controller 1 does not respond to a query from the personal computer 2.

Moreover, the output terminals of both of the controller 1 and the personal computer 2 are connected to a hub 5, wherein the plurality of output devices 4 or mail receipt notifying devices can be notified of a message via the hub 5.

Figure 7:
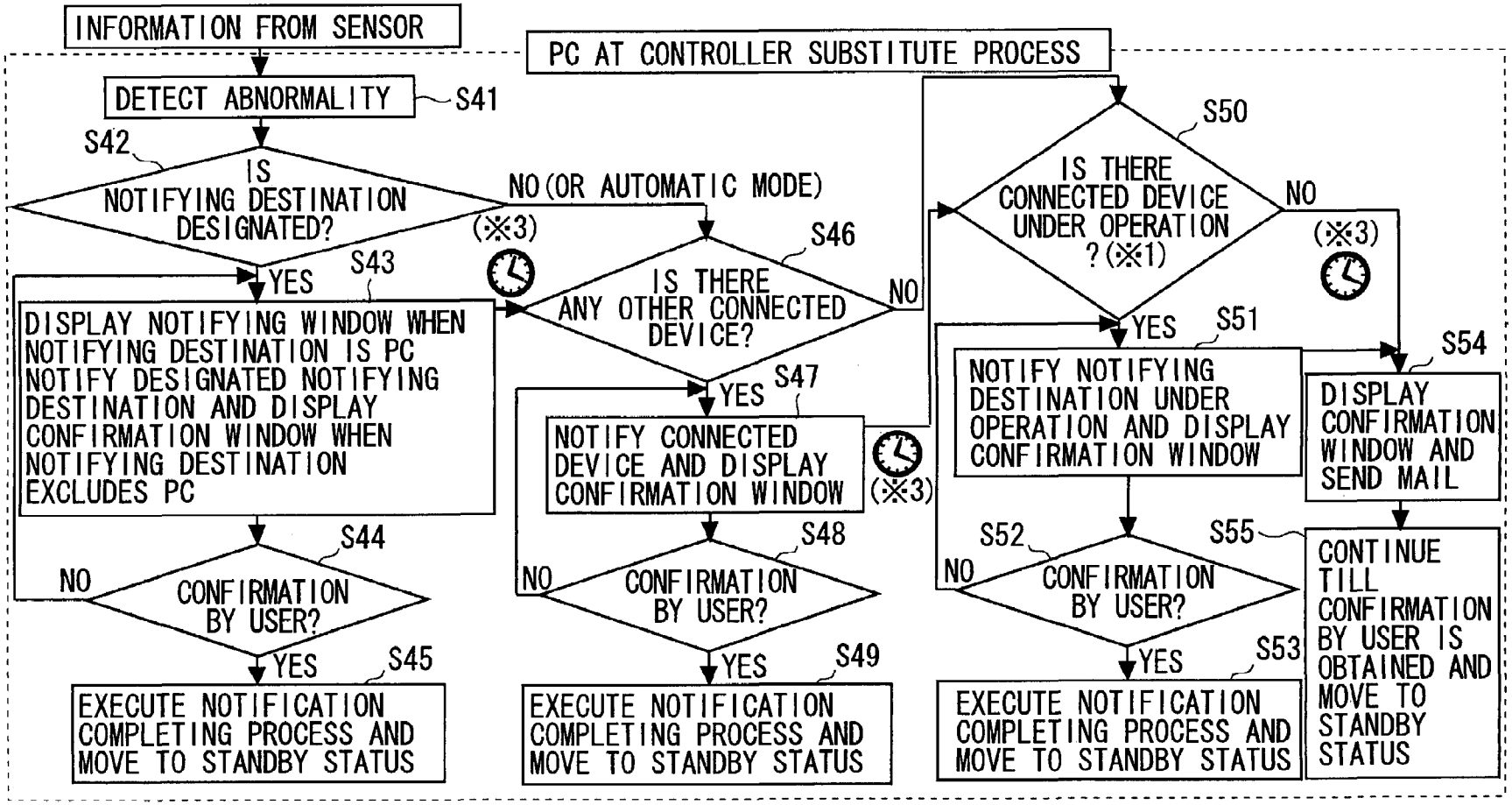
FIG. 7 is a flowchart showing a controller substitute process by the personal computer 2.

FIG. 7 is a flowchart showing a controller substitute process by the personal computer 2. This process is executed by the personal computer 2 as a substitute for the controller 1 when the personal computer 2 detects a fault of the controller 1.

In this controller substitute process, to begin with, the personal computer 2 detects the abnormality from the information given from the sensors (S41).

When the abnormality is detected, the personal computer 2 judges whether or not the notifying destination is designated with respect to this abnormality (S42). When the notifying destination is designated, the personal computer 2 executes a process corresponding to the designated notifying destination (S43).

For instance, if the notifying destination is the personal computer 2, the personal computer 2 displays the notifying window on the display device of the personal computer 2 itself. Further, if the notifying destination excludes the personal computer 2, the personal computer 2 notifies the designated notifying destination. Moreover, the personal computer 2 causes the notifying destination to display a confirmation window. Herein, the confirmation window connotes a window on which the user is notified of the abnormality or the state variation, etc. and is prompted to input that the user has recognized a content of the notification. A confirmation button by which the user inputs the confirmation is provided on the confirmation window.

Then, the personal computer 2 judges whether or not the user has confirmed the notification on the notifying window of the personal computer 2 itself or on the confirmation window at the notifying destination described above (S44).

When there is the confirmation by the user, the personal computer 2 executes the notification completing process, and returns to the standby status (S45). While on the other hand, when the response about the confirmation by the user is not obtained, the personal computer 2 returns the control to S43. The processes in S43 and S44 are repeated till the confirmation by the user is obtained.

Then, if there is none of the confirmation by the user even after a predetermined period of time has elapsed, i.e., if the user is not aware of the notification, the personal computer 2 moves to the automatic mode. Further, when judging the notifying destination not to be set in S42, the personal computer 2 likewise moves to the automatic mode.

According to the second embodiment, in the automatic mode, the personal computer 2 judges whether there is any other connected device or not (S46). Then, when there is the device connected to the personal computer 2, the personal computer 2 notifies the connected device and makes this connected device to display the confirmation window (S47).

Then, the personal computer 2 judges whether or not the user has confirmed the notification on the confirmation window of the aforementioned connected device (S48).

When there is the confirmation by the user, the personal computer 2 executes the notification completing process, and returns to the standby status (S49). While on the other hand, when the response about the confirmation by the user is not obtained, the personal computer 2 returns the control to S47. The processes in S47 and S48 are repeated till the confirmation by the user is obtained.

Then, if there is none of the confirmation by the user even after a predetermined period of time has elapsed, i.e., if the user is not aware of the notification, the personal computer 2 moves to a judging process in S50. Further, when judging in S46 that there is not any other connected device, the personal computer 2 likewise moves to the judging process in S50. In the judging process in S50, the personal computer 2 judges whether or not there is any connected device under operation.

When judging in S50 that there is the connected device under operation, the personal computer 2 sends the notification to the connected device and makes this connected device display the confirmation window (S51). Then, the CPU 10 judges whether or not the user has confirmed the notification at the notifying destination (S52).

When the response about the confirmation by the user is sent from the notifying destination, the personal computer 2 executes the notification completing process and returns to the standby status (S53). While on the other hand, when the response about the confirmation by the user is not obtained, the personal computer 2 returns the control to S51. The processes in S51 and S52 are repeated till the confirmation by the user is obtained.

Then, if there is none of the confirmation by the user even after a predetermined period of time has elapsed, i.e., if the user is not aware of the notification, the personal computer 2 moves to a process in S54. Further, when judging in S50 that none of the connected devices at the notifying destination are started, the personal computer 2 likewise moves to the process in S54.

The processes in S54 and S55 are executed in a case such as the absence of the user, etc. and are the same as those in S34 and S35 in FIG. 5 according to the first embodiment (the personal computer 2, however, gets the confirmation window displayed instead of flickering the lamp).

As discussed above, according to the information system in the second embodiment, if the controller 1 falls into the fault, the personal computer 2 detects this fault and can, as the substitute for the controller 1, notify the user of the abnormality or the state variation in the sensor data.

<Modified Example>

In the second embodiment discussed above, the personal computer 2 executes the substitute function when the controller 1 falls into the fault or disorder. If the controller 1 falls into neither the fault nor the disorder, however, the personal computer 2 may execute the function of the controller 1. Namely, both of the controller 1 and the personal computer 2 may monitor the sensors.

<<Third Embodiment>>

Figure 8:
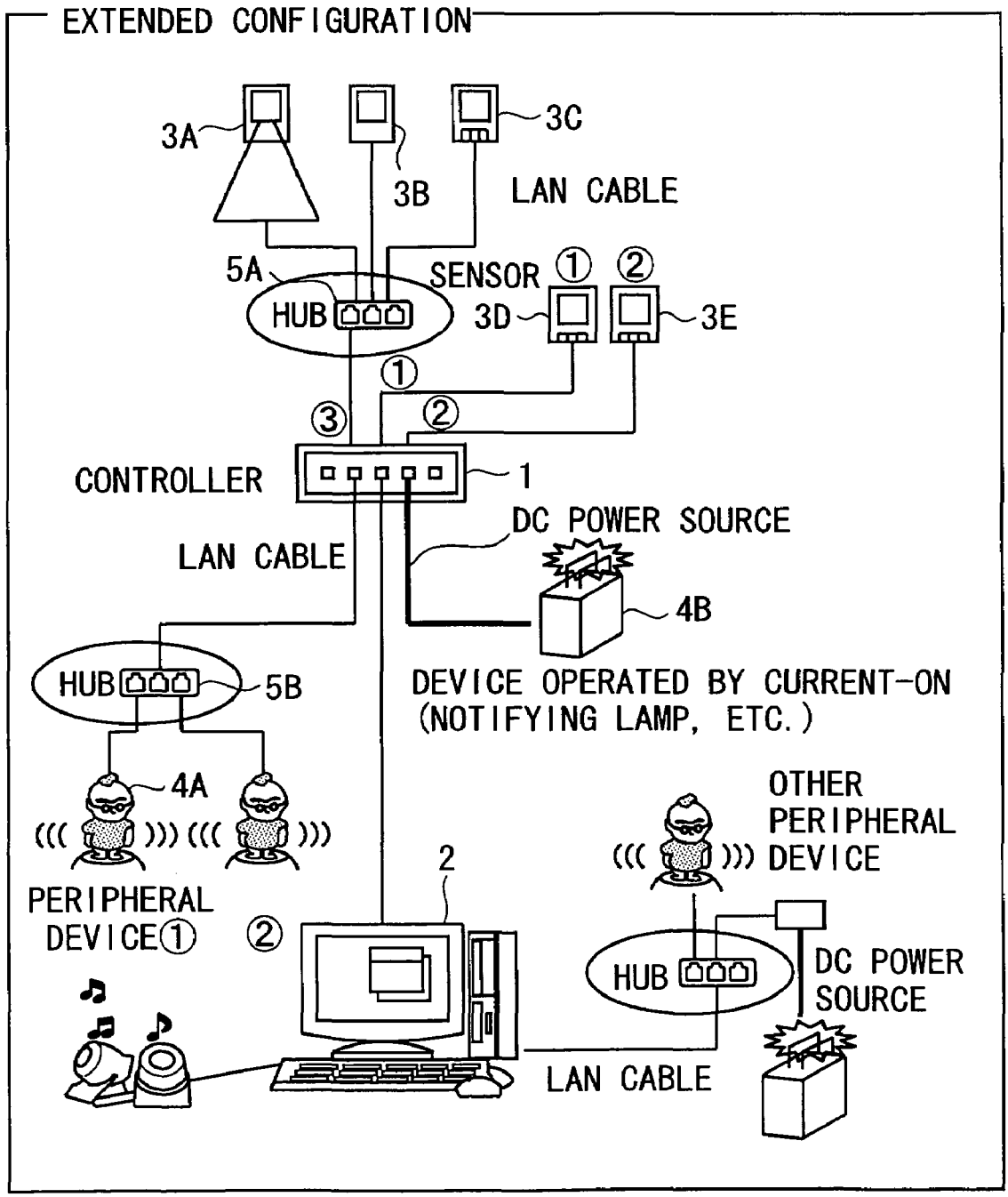
FIG. 8 is a view of a system architecture of the information system in a third embodiment of the present invention.

A third embodiment of the present invention will be explained with reference to FIG. 8. FIG. 8 is a view of a system architecture of the information system according to the third embodiment.

In this information system, the sensors 3A, etc. are connected to the controller 1 via a hub 5A. Some (e.g., sensors 3D, 3E, etc. in FIG. 8) among the sensors may, however, be connected directly to the controller 1.

In the architecture in FIG. 8, the signals from the plurality of sensors 3A through 3C are inputted to one single input terminal of the controller 1 via the hub 5A. This configuration makes it possible to detect a synthesized signal of the sensor signals of the sensors installed in a plurality of positions. For example, the sensors 3A through 3C are installed in different positions within the entrance hall, thereby enabling enhancement of certainty of detecting a detection object (e.g., a visitor or trespasser, etc.).

Moreover, the controller 1 is connected via the hub 5A to the output devices 4. Part (e.g., the output device 4B, etc. in FIG. 8) of the output devices may, however, be connected directly to the controller 1. Thus, a flexible extension of the notifying destinations can be attained through the hub.

<<Storage Medium Readable by Computer, etc.>>

A storage medium readable by a computer, etc. can be stored with the program for making the computer, other device, machine, etc. (which will hereinafter be referred to as the computer, etc.) actualize any one of the aforementioned functions. Then, the computer, etc. reads and executes the program on this storage medium, whereby the function thereof can be provided.

Herein, the storage medium readable by the computer, etc. connotes a storage medium capable of storing information such as data, programs, etc. electrically, magnetically, optically and mechanically or by chemical action, which can be read by the computer. What is demountable out of the computer, etc. among those storage mediums may be, e.g., a flexible disc, a magneto-optic disc, a CD-ROM, a CD-R/W, a DVD, a DAT, an 8 mm tape, a memory card, etc.

Further, a hard disc, a ROM (Read Only Memory) and so on is given as storage medium fixed in the computer, etc.

<<Data Communication Signal Embodied in Carrier Wave>>

Furthermore, the above program may be stored in the hard disc and the memory of the computer, etc., and can be distributed to other computers via communication media. In this case, the program is transmitted as data communication signals embodied in carrier waves via the communication media. Then, the computer receiving the distribution thereof can be made to provide the aforementioned function.

Herein, the communication media may be any one of cable communication mediums such as metallic cables including a coaxial cable and a twisted pair cable, optical communication cables, or wireless communication media such as satellite communications, ground wave wireless communications, etc.

Further, the carrier waves are electromagnetic waves for modulating the data communication signals, or the light. The carrier waves may, however, be DC signals. In this case, the data communication signal takes a base band waveform with no carrier wave. Accordingly, the data communication signal embodied in the carrier wave may be any one of a modulated broadband signal and an unmodulated base band signal (corresponding to a case of setting a DC signal having a voltage of 0 as a carrier wave).

INDUSTRIAL APPLICABILITY

The present invention can be applied to a manufacturing industry and a sales industry of housing equipment, welfare equipment, building management equipment, a plant system, management equipment in a laboratory, office management equipment, etc., and to a service industry utilizing these types of equipment.

What is claimed is:

1. A monitoring apparatus comprising:

a sensor monitoring unit monitoring a sensor;

a notifying unit notifying, when said sensor detects a predetermined state, a first notifying destination of this purport;

a notification confirming unit confirming that the notification has been recognized by a user at said first notifying destination;

a notifying destination recording unit recording a plurality of notifying destinations;

an operation detecting unit detecting operation states of the plurality of notifying destinations; and a control unit determining, if unable to confirm that the notification has been recognized by a user after a predetermined period of time has elapsed, a notifying destination under operation as a second notifying destination based on the operation states of the plurality of notifying destinations and making said notifying means to give the notification to the second notifying destination.

2. A processing apparatus connected to a monitoring apparatus comprising a sensor monitoring unit monitoring a sensor, a notifying unit notifying, when said sensor detects a predetermined state, a first notifying destination of this purport, a notification confirming unit confirming that the notification has been recognized by a user at said notifying destination, a notifying destination recording unit recording a plurality of notifying destinations, an operation detecting unit detecting operation states of the notifying destinations, and a control unit determining, if unable to confirm that the notification has been recognized by a user after a predetermined period of time has elapsed, a notifying destination under operation as a second notifying destination based on the operation states of the plurality of notifying destinations and making said notifying means to give the notification to the second notifying destination, said processing apparatus being connected to said sensor and receiving the notification from said monitoring apparatus, said processing apparatus comprising:

a communication unit communicating with said monitoring apparatus;

an operation judging unit judging an operation state of said monitoring apparatus; and a substitute unit functioning, if said monitoring apparatus is not under operation, as said sensor monitoring unit, said notifying unit and said control unit.

3. A monitoring system comprising a monitoring apparatus for monitoring a sensor and a processing apparatus for receiving a notification from said monitoring apparatus, said monitoring apparatus including:

a sensor monitoring unit monitoring a sensor;

a notifying unit notifying, when said sensor detects a predetermined state, a first notifying destination of this purport;

a notification confirming unit confirming that the notification has been recognized by a user at said notifying destination;

a notifying destination recording unit recording a plurality of notifying destinations;

an operation detecting unit detecting operation states of the plurality of notifying destinations; and a control unit determining, if unable to confirm that the notification has been recognized by a user after a predetermined period of time has elapsed, a notifying destination under operation as a second notifying destination based on the operation states of the plurality of notifying destinations and making said notifying means to give the notification to the second notifying destination, said processing apparatus including:

a communication unit communicating with said monitoring apparatus;

an operation judging unit judging an operation state of said monitoring apparatus; and a substitute unit functioning, if said monitoring apparatus is not under operation, as said sensor monitoring unit, said notifying unit and said control unit.

4. A sensor monitoring method comprising:

monitoring a sensor;

notifying, when said sensor detects a predetermined state, a first notifying destination of this purport;

confirming that the notification has been recognized by a user at said first notifying destination;

referring to a plurality of notifying destinations;

detecting operation states of the plurality of notifying destination; and determining, if unable to confirm that the notification has been recognized by a user after a predetermined period of time has elapsed, a notifying destination under operation as a second notifying destination based on the operation states of the plurality of notifying destinations and making said notifying means to give the notification to the second notifying destination.

5. A computer readable medium encoded with a computer program for making a computer execute:

monitoring a sensor;

notifying, when said sensor detects a predetermined state, a first notifying destination of this purport;

confirming that the notification has been recognized by a user at said first notifying destination;

referring to a plurality of notifying destinations;

detecting an operation state of the notifying destination; and determining, if unable to confirm that the notification has been recognized by a user after the predetermined period of time has elapsed, the notifying destination under operation as a second notifying destination based on the operation states of the plurality of notifying destinations and getting the notification given to the second notifying destination.

6. A method for making a computer, connected to a monitoring apparatus comprising a sensor monitoring unit monitoring a sensor, a notifying unit notifying, when said sensor detects a predetermined state, a first notifying destination of this purport, a notification confirming unit confirming that the notification has been recognized by a user at said notifying destination, a notifying destination recording unit recording a plurality of notifying destinations, an operation detecting unit detecting an operation state of the notifying destination, and a control unit determining, if unable to confirm that the notification has been recognized by a user after the predetermined period of time has elapsed, the notifying destination under operation as a second notifying destination based on the operation states of the plurality of notifying destinations and making said notifying means give the notification to the second notifying destination, said computer being connected to said sensor, execute:

communicating with said monitoring apparatus;

judging an operation state of said monitoring apparatus; and functioning, if said monitoring apparatus is not under operation, as said sensor monitoring unit, said notifying unit and said control unit.

7. A computer readable storage medium readable by a computer, encoded with a program of instructions executable by the computer to perform method comprising:

monitoring a sensor;

notifying, when said sensor detects a predetermined state, a first notifying destination of this purport;

confirming that the notification has been recognized by a user at said first notifying destination;

referring to a plurality of notifying destinations;

detecting operation states of the plurality of notifying destinations; and determining, if unable to confirm that the notification has been recognized by a user after a predetermined period of time has elapsed, a notifying destination under operation as a second notifying destination based on the operation states of the plurality of notifying destinations and getting the notification given to the second notifying destination.

8. A computer readable storage medium readable by a computer, encoded with a program of instructions executable by the computer, connected to a monitoring apparatus comprising a sensor monitoring unit monitoring a sensor, a notifying unit notifying, when said sensor detects a predetermined state, a first notifying destination of this purport, a notification confirming unit confirming that the notification has been recognized by a user at said notifying destination, a notifying destination recording unit recording a plurality of notifying destinations, an operation detecting unit detecting operation states of the plurality of notifying destination, and a control unit determining, if unable to confirm that the notification has been recognized by a user after a predetermined period of time has elapsed, a notifying destination under operation as a second notifying destination based on the operation states of the plurality of notifying destinations and making said notifying means to give the notification to the second notifying destination, said computer being connected to said sensor, to perform method including:

communicating with said monitoring apparatus;

judging an operation state of said monitoring apparatus; and functioning, if said monitoring apparatus is not under operation, as said sensor monitoring unit, said notifying unit and said control unit.

9. A monitoring apparatus according to claim 1, further comprising:

a searching unit searching for an other apparatus enabling to communicate with said monitoring apparatus if none of the plurality of notifying destinations are recorded by the notifying destination recording unit, wherein the control unit determines the other device under operation searched by the searching unit as the second notifying destination.

10. A sensor monitoring method according to claim 4, further comprising:

searching for an other notifying destination enabling to detect the operation states if none of the plurality of notifying destinations is referred by the referring, wherein the determining step determines the other notifying destination under operation searched by the searching step as the second notifying destination.

11. A computer readable medium encoded with a computer program according to claim 5, further making said computer execute:

searching for an other notifying destination enabling to detect the operation states if none of the plurality of notifying destinations is referred by the referring step, wherein the determining step determines the other notifying destination under operation searched by the searching step as the second notifying destination.

12. A computer readable storage medium readable by the computer according to claim 7, further comprising steps of:

searching for an other notifying destination enabling to detect the operation states if none of the plurality of notifying destinations is referred by the referring step, wherein the determining step determines the other notifying destination under operation searched by the searching step as the second notifying destination.

13. A notification method ensuring confirmation of a notification submitted when a sensor detects a predetermined state, comprising:

sending a notification to a first notifying destination when the sensor detects the predetermined state;

determining a second notifying destination from a plurality of notifying destinations based on detecting operation states of each of the plurality of notifying destinations; and sending the notification to the second notifying destination, if the first notifying destination does not confirm the notification within a predetermined period of time.

* * * * *